US008543034B2

(12) United States Patent
Ishii

(10) Patent No.: US 8,543,034 B2
(45) Date of Patent: Sep. 24, 2013

(54) ELECTROPHOTOGRAPHIC COLOR IMAGE FORMING APPARATUS AND CARTRIDGE

(75) Inventor: Hirotaka Ishii, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 136 days.

(21) Appl. No.: 13/163,017

(22) Filed: Jun. 17, 2011

(65) Prior Publication Data

US 2011/0311274 A1 Dec. 22, 2011

(30) Foreign Application Priority Data

Jun. 21, 2010 (JP) ..... 2010-140473

(51) Int. Cl.
*G03G 21/18* (2006.01)
*G03G 15/08* (2006.01)

(52) U.S. Cl.
USPC ..... 399/113; 399/119

(58) Field of Classification Search
USPC ..... 399/13, 113, 110, 111, 117, 119, 399/106, 108
See application file for complete search history.

(56) References Cited

U.S. PATENT DOCUMENTS 4,996,566 A * 2/1991 Morita et al. ..... 399/28
5,486,898 A 1/1996 Fujii et al.
6,898,402 B2 * 5/2005 Kim ..... 399/222
2005/0002689 A1 * 1/2005 Jeong et al. ..... 399/111
2006/0083544 A1 * 4/2006 Okabe ..... 399/111

FOREIGN PATENT DOCUMENTS

JP 07152303 A * 6/1995
JP 2005-91410 A 4/2005

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

A color electrophotographic image forming apparatus for forming a color image on a recording material, the apparatus includes a main assembly; a drum cartridge including an electrophotographic photosensitive drum and detachably mountable to the main assembly of the apparatus of an electrophotographic image forming apparatus; a plurality of developing cartridges each comprising a developing roller for developing an electrostatic latent image formed on electrophotographic photosensitive drum of the drum cartridge mounted to the main assembly; a main assembly side drum cartridge guide for guiding the drum cartridge; a main assembly side drum cartridge positioning portion for positioning the drum cartridge to the main assembly of the apparatus; wherein the drum cartridge is provided with a positioning portion for positioning the developing cartridge relative to the drum cartridge with respect to an entering direction of the developing cartridge, and the developing cartridge is provided with insertion guide means for guiding insertion of a developing cartridge right thereabove.

17 Claims, 11 Drawing Sheets

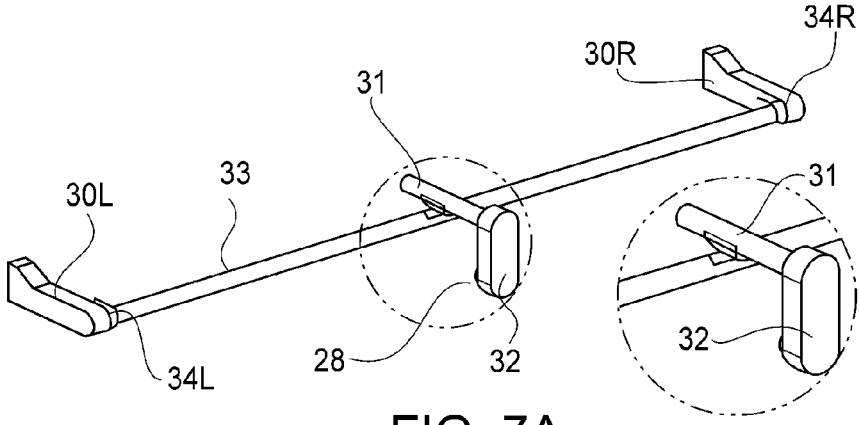
FIG. 7A
FIG. 7B
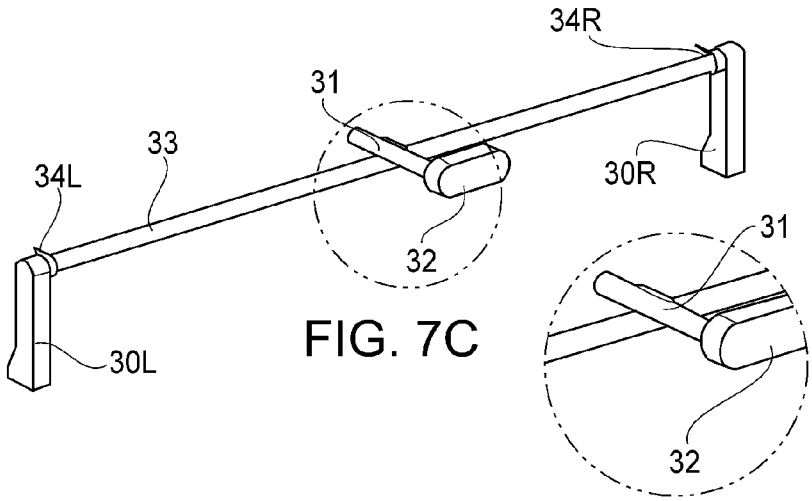
FIG. 7C
FIG. 7D

ELECTROPHOTOGRAPHIC COLOR IMAGE FORMING APPARATUS AND CARTRIDGE

FIELD OF THE INVENTION AND RELATED ART

The present invention relates to an electrophotographic color image forming apparatus which forms an image on recording medium with the use of multiple cartridges removably mountable in the main assembly of the image forming apparatus. It relates to also a cartridge removably mountable in the main assembly of an electrophotographic color image forming apparatus.

In the following description of the present invention, the term "electrophotographic color image forming apparatus" means an apparatus for forming a color image on recording medium, with the use of an electrophotographic image formation process. Examples of an electrophotographic color image forming apparatus include an electrophotographic color copying machine, an electrophotographic color printer (color laser beam printer, color LED printer, etc.), a color facsimile machine, a color word processor, etc. The term "recording medium" means medium on which an image is formed by an electrophotographic image forming apparatus. "Recording medium" includes paper, an OHP sheet, and the like, for example.

The term "cartridge" means a process cartridge or a development cartridge, for example, which is removably mountable in the main assembly of an electrophotographic image forming apparatus and contributes to an image formation process for forming an image on recording medium. The term "process cartridge" means a cartridge in which an electrophotographic photosensitive drum, and at least one processing means among a charging means, a developing means, and a cleaning means, are integrally placed, and which is removably mountable in the main assembly of an image forming apparatus. A processing means is a means for processing an electrophotographic photosensitive drum (which hereafter may be referred to simply as drum). Thus, the term "process cartridge" includes: a cartridge in which a drum and a developing apparatus (processing means) are integrally placed, and which is removably mountable in the main assembly of an image forming apparatus; and a cartridge in which a drum, a charging means, and a developing means or cleaning means, are integrally placed, and which is removably mountable in the main assembly of an image forming apparatus. A cartridge in which a drum and a developing apparatus (processing means) are integrally placed is referred to as a cartridge of the integration type, whereas a cartridge in which a drum and processing means other than a developing means are integrally placed is referred to as a cartridge of the separation type. A process cartridge can be removably mounted in the main assembly of an image forming apparatus by a user himself or herself. Therefore, it can make easier the maintenance of the main assembly of an image forming apparatus.

A development cartridge has a development roller. It stores the developer (toner) which is used by the development roller to develop an electrostatic latent image formed on the peripheral surface of a drum. It is removably mountable in the main assembly of an image forming apparatus. In the case of an image forming apparatus which employs a development cartridge, the main assembly of the image forming apparatus has a drum, or it employs a process cartridge of the separation type, which has a drum (but, does not have developing means). A development cartridge also can be removably mounted in the main assembly of an image forming apparatus. Therefore, it can make it easier to maintain the main assembly of an image forming apparatus.

Thus, the "process cartridge" includes a process cartridge of the so-called integration type as well as separation type. Some electrophotographic image forming apparatuses employ a process cartridge of the so-called integration type, in combination with a process cartridge of the so-called separation type. There are also electrophotographic image forming apparatuses, the drum of which is attached to the main assembly of the apparatus. In the cases of the latter apparatuses, the drum is attached to the main assembly of the apparatus, and a development cartridge which is removably mountable in the main assembly is employed.

In the field of an electrophotographic color image forming apparatus, a photosensitive drum and a development roller are different in durability. Therefore, a process cartridge is likely to be of the separation type. That is, a drum is placed only in a drum cartridge; it is not placed in a development cartridge which comprises a development roller and a frame (in which developer is stored). In such a case, a drum cartridge is precisely positioned relative to the main assembly of an image forming apparatus, by a pair of guides attached to the left and right plates of the main assembly, whereas a development cartridge is precisely positioned relative to the main assembly by another pair of guides attached to the left and right plates of the main assembly as disclosed in U.S. Pat. No. 6,898,402. Further, the lengthwise end portions of a development roller are fitted with a pair of rings which are coaxial with the development roller. Thus, the positional relationship, more specifically, the gap, between the drum in a drum cartridge, and the development roller in a development cartridge, is maintained by the contact between the rings and the peripheral surface of the drum.

In the case of the conventional image forming apparatus described above, however, the drum cartridge and development cartridge are independently positioned from each other relative to the main assembly of the image forming apparatus. Thus, if the drum cartridge has to be replaced, all the development cartridges in the main assembly had to be removed, and then, remounted after the mounting of a replacement drum cartridge. Further, not only did the lateral plates of the main assembly have to be shaped to guide the development cartridges, but also, the lengthwise ends of each development cartridge had to be shaped so that the development cartridge could be guided by the lateral plates of the main assembly. This created a problem. That is, providing the lateral plates of the main assembly of the image forming apparatus with cartridge guiding members, or shaping the lateral plates of the main assembly so that they can guide the cartridges, made the main assembly wider.

SUMMARY OF THE INVENTION

Thus, the primary object of the present invention is to provide an electrophotographic color image forming apparatus, the drum cartridge for which is significantly easier to mount or dismount, and narrower, than any of the conventional drum cartridges; the development cartridges for which also are significantly narrower, than any of the conventional development cartridges; and therefore, the main assembly of which is significantly smaller than the main assembly of any of the conventional electrophotographic image forming apparatuses.

According to an aspect of the present invention, there is provided a color electrophotographic image forming apparatus for forming a color image on a recording material, said apparatus comprising a main assembly; a drum cartridge including an electrophotographic photosensitive drum and detachably mountable to said main assembly of the apparatus of an electrophotographic image forming apparatus; a plurality of developing cartridges each comprising a developing roller for developing an electrostatic latent image formed on electrophotographic photosensitive drum of said drum cartridge mounted to said main assembly; a main assembly side drum cartridge guide for guiding said drum cartridge; a main assembly side drum cartridge positioning portion for positioning said drum cartridge to said main assembly of the apparatus; wherein said drum cartridge is provided with a positioning portion for positioning said developing cartridge relative to said drum cartridge with respect to an entering direction of said developing cartridge, and said developing cartridge is provided with insertion guide means for guiding insertion of a developing cartridge right thereabove.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIGS. 7A, 7B, 7C and 7D are perspective views of the development cartridge legs, in the third preferred embodiment, for temporarily supporting the development cartridge, and describe how the legs temporarily support the development cartridge.

DESCRIPTION OF THE PREFERRED EMBODIMENTS

Embodiment 1

(General Structure of Electrophotographic Image Forming Apparatus)

Figure 1A:
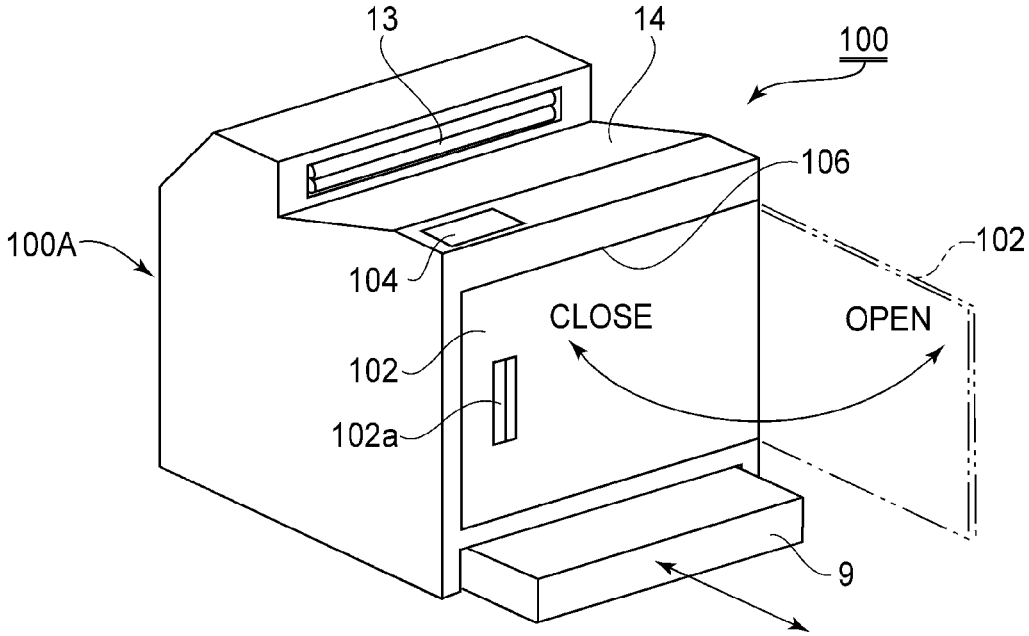
FIGS. 1A and 1B are external perspective views of the electrophotographic color image forming apparatus in the first preferred embodiment of the present invention when the front door of the apparatus is closed and open, respectively.
Figure 1B:
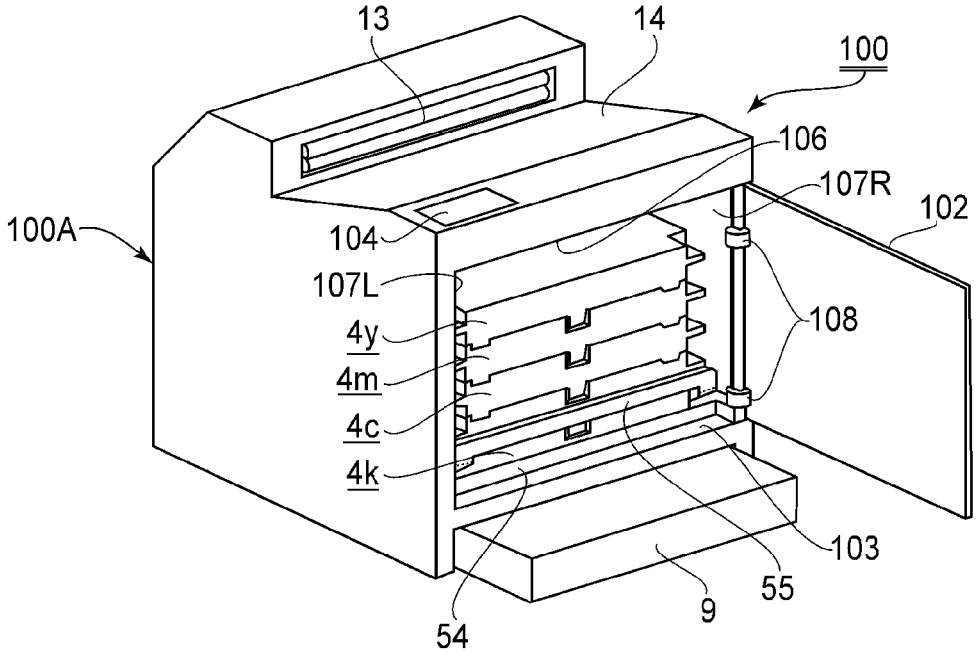
Figure 2A:
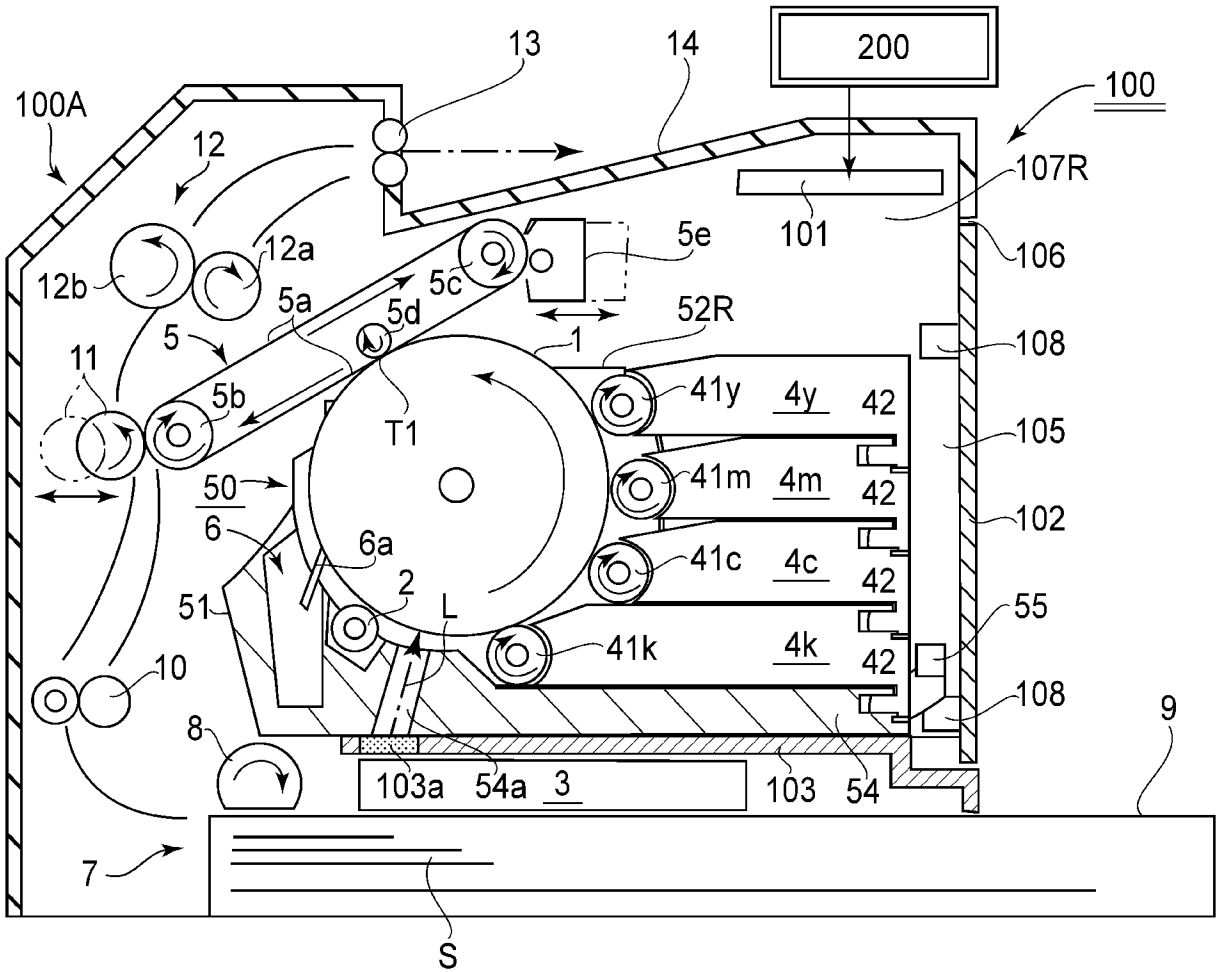
FIG. 2A is a schematic vertical sectional view of the image forming apparatus in the first preferred embodiment of the present invention, as seen from the right-hand side of the apparatus.

FIGS. 1A and 1B are external perspective views of the electrophotographic color image forming apparatus 100 (which hereafter may be referred to simply as "apparatus 100") in the first preferred embodiment of the present invention when the front door of the apparatus 100 is closed and open, respectively. FIG. 2A is a schematic vertical sectional view of the image forming apparatus 100 in the first preferred embodiment of the present invention, as seen from the right-hand side of the apparatus 100. The apparatus 100 is a full-color laser printer based on the four primary colors. It forms color images on a sheet S of recording medium in response to electrical image formation signals inputted to the control circuit 101 of the apparatus 100 from a host apparatus, such as a personal computer. The main assembly 100A of the apparatus 100 (which hereafter may be referred to simply as "main assembly 100A") is structured so that a drum cartridge 50, which has an electrophotographic photosensitive drum 1 (which hereafter may be referred to simply as "drum 1") is removably mountable in the main assembly 100A, and also, so that multiple development cartridges 4 (4*y*, 4*m*, 4*c*, and 4*k*), which have development rollers 41 (41*y*, 41*m*, 41*c*, and 41*k*, respectively) are removably mountable.

In the following descriptions of the preferred embodiments of the present invention, the front side, or front surface side, of the apparatus 100 is where the front door 102 of the apparatus 100 is. The rear side is the opposite side from the front side. Further, the front-rear direction means the rear-to-front direction (frontward direction) of the apparatus 100 as well as the front-to-rear direction of the apparatus 100 (rearward direction), that is, the opposite direction from the rear-to-front direction. The left-right direction means left-to-right direction (rightward direction) as well as the right-to-left direction (leftward direction), that is the opposite direction from the left-to-right direction. The upward and downward directions are relative to the gravity direction. The main assembly 100A is what will remain after the removal of the cartridges 50 and 4.

The main assembly 100A is structured so that after the proper mounting of the cartridge 50, the drum 1 of the cartridge 50 is roughly at the center of the main assembly 100A. The drum 1 is rotated in the counterclockwise direction indicated by an arrow mark. It is also structured so that after the proper mounting of the cartridge 50 and 4 into the main assembly 100A, the charging device 2, developing device 4, drum cleaning device 6, which are the drum processing means, are in the adjacencies of the peripheral surface of the drum 1, listing in the order in which they process the drum 1 in terms of the drum rotation direction. The main assembly 100A is also provided with an image writing device 3 (drum exposing device 3), and an intermediary transferring device 5.

The drum 1 is an organic photoconductive member. It comprises an aluminum cylinder, and an organic photoconductive layer coated on the peripheral surface of the aluminum cylinder. The drum 1 is rotatably supported between the left and right plates 52L and 52R (FIG. 2B) of the drum cartridge frame 51, by the left and right plates 52L and 52R. More concretely, the left and right plates 52L and 52R are provided with a pair of bearing 53, and the left and right end portions of the drum 1 are rotatably supported by the bearings 53, one for one. One (driving side) of the lengthwise ends of the drum shaft is fitted with a driving force transmitting component (unshown), through which the drum 1 receives the drum driving force from the motor (unshown) of the main assembly 100A. As the driving force is transmitted to this driving force transmitting component from the motor of the main assembly 100A, the drum 1 rotates in the counterclockwise direction at a preset velocity.

The charging device 2 in this embodiment is of the so-called contact type. It is an electrically conductive roller. The roller 2 is rotatably supported between the left and right plates 52L and 52R of the drum cartridge frame 51, being in contact with the peripheral surface of the drum 1 and roughly in parallel with the drum 1. It is rotated by the rotation of the drum 1. As a preset charge bias (voltage) is applied to the roller 2 from the electric power source (unshown) of the main assembly 100A, the peripheral surface of the drum 1 is uniformly charged to a preset polarity and a potential level.

The image writing device 3 (drum exposing device 3) in this embodiment is a laser scanner. It is solidly attached to the bottom surface of a plate 103 which is a part of the bottom portion of the main assembly 100A. The unit 3 has a laser diode, a polygon mirror, an F-θ lens, a deflection mirror, etc. It outputs a beam L of laser light while modulating the beam L according to the information regarding each of the yellow, magenta, cyan, and black monochromatic images, into which the image to be formed has been separated, inputted into the control circuit 101 from a host apparatus 200. As the beam L is outputted from the unit 3, it is made to converge to the downwardly facing portion of the peripheral surface of the drum 1, through the exposure hole 103*a* of the frames 103, and exposure hole 54*a* of the bottom plate 54 of the frame 51, respectively. Thus, the uniformly charged portion of the peripheral surface of the drum 1 is scanned (exposed) by the beam L. Consequently, an electrostatic latent image, which reflects the pattern in which the peripheral surface of the drum 1 was exposed, is effected on the peripheral surface of the drum 1.

The developing device 4 is a device which develops an electrostatic latent image on the drum 1, into a visible image, with the use of developer (toner). The image forming apparatus 100 in this embodiment employs four development cartridges 4, that is, the first to fourth development cartridges 4 (4*y*, 4*m*, 4*c*, and 4*k*), which are different only in the color of the developer they store. When the four developing cartridges 4 are in the main assembly 100A, they are vertically stacked between the drum 1 and the front door 102 of the main assembly 100A. In this embodiment, the first cartridge 4*y* is at the top, and the second cartridge 4*m* is immediately below the first cartridge 4*y*. The third cartridge 4*c* is immediately below the second cartridge 4*m*, and the fourth cartridge 4*k* is right at the bottom. Each cartridge 4 is removably mountable in the main assembly 100A. This setup will be described later in more detail. Each cartridge 4 has: a development roller 41 (41*y*, 41*m*, 41*c*, or 41*k*) which supplies the drum 1 with developer; and a frame 42, a part of which stores the developer to be used by the development roller 41 to develop the electrostatic latent image. The first cartridge 4*y* stores yellow (y) developer, and will be referred to as a yellow cartridge, hereafter. The second cartridge 4*m* stores magenta developer, and will be referred to as a magenta cartridge, hereafter. The third cartridge 4*c* stores cyan (c) developer, and will be referred to as a cyan cartridge, hereafter. The fourth cartridge 4*k* stores black (k) developer, and will be referred to as a black cartridge, hereafter. The four cartridges 4*y*, 4*m*, 4*c*, and 4*k* can be selectively operated and controlled to develop an electrostatic latent image on the peripheral surface of the drum 1. That is, as the development roller 41, etc., of the selected cartridge 4 is driven, and a preset development bias is applied to the roller 41 from the electric power source (unshown) of the main assembly 100A, the electrostatic latent image on the drum 1 is developed by the corresponding cartridge 4. In other words, the electrostatic latent image on the drum 1 is developed with the use of developer by the roller 41. In this embodiment, the black cartridge 4*k*, or the bottom-most cartridge, is made greater in developer (toner) capacity, compared to the other cartridges 4*y*, 4*m*, and 4*c*, because the black developer (toner) is greater in the frequency of usage than the other developers (toners).

An intermediary transferring device 5 in this embodiment is a unit onto which a toner image (developed electrostatic latent image) is intermediately transferred. This unit 5 has an intermediary transfer belt 5*a* (which hereafter may be referred to simply as belt 5*a*), which is endless, flexible, and made of a dielectric substance. The unit 5 has also: first and second rollers 5*b* and 5*c*, respectively, by which the belt 5*a* is suspended and kept stretched; and a first transfer roller 5*d*, which is between the rollers 5*b* and 5*c* in terms of the belt movement direction, and is kept pressed against the drum 1, with the presence of the belt 5*a* between the roller 5*d* and drum 1. The area of contact between the drum 1 and belt 5*a* is the first transfer nip T1. The unit 5 has also a second transfer roller 11, the position of which corresponds to the portion of the roller 5*b*, around which the belt 5 is wrapped. The roller 11 is switchable in position by a roller moving mechanism (unshown) between a first position in which the roller 11 is kept pressed against the roller 5*b* with the presence of the belt 5*a* between the roller 11 and roller 5*b*, being therefore capable of transferring a toner image, and a second position in which the roller 11 is kept separated from the belt 5*a*, being therefore incapable of transferring a toner image. When the roller 11 is not needed for toner image transfer, it is kept in the second position, that is, the position in which it is kept separated from the belt 5*a*. When the roller 11 is needed for toner image transfer, it is moved, with preset control timing, to the first position, that is, the position in which it is enabled to transfer a toner image. The area of contact between the roller 11 and belt 5*a* when the roller 11 is in the first position is the second transfer nip T2.

The image forming apparatus 100 is provided with a belt cleaning device 5*e* for cleaning the surface of the belt 5*a*. The belt cleaning device 5*e* is positioned so that its position corresponds with the portion of the peripheral surface of the roller 5*c*, around which the belt 5*a* wraps. The cleaning device 5*e* is switchable in position between a first position in which the cleaning member of the cleaning device 5*e* is in contact with the surface of the belt 5*a*, and a second position in which the cleaning member is kept separated from the surface of the belt 5*a*. When the cleaning device 5*e* is not needed, it is kept in the second position. When the belt 5*a* needs to be cleaned, the cleaning device 5*e* is moved to the second position with preset control timing.

The image forming apparatus 100 is also provided with a cleaning device 6, which is the means for removing from the peripheral surface of the drum 1, the transfer residual toner, that is, the toner remaining on the peripheral surface of the drum 1 after the transfer of a developer image (toner image) from the drum 1 onto the belt 5*a*. The cleaning member of the cleaning device 6 in this embodiment is a blade 6*a* (cleaning blade). After being removed from the peripheral surface of the drum 1, the transfer residual toner is stored in a waste developer storage chamber 6*b*, which in this embodiment is a part of the frame 51 (drum cartridge frame).

As an image formation start signal is inputted, the control circuit 101 starts the main motor (unshown), whereby not only does the drum 1 begin to be rotated at a preset peripheral velocity, but also the belt 5*a* begins to be circularly driven at the same peripheral velocity as the drum 1, in such a direction that the direction of its movement in the interface between the belt 5*a* and drum 1 is the same as the direction of the movement of the peripheral surface of the drum 1 in the interface. As for the roller 11 and cleaning device 5*e*, they are kept in their second positions, in which they are away from the belt 5*a*. Further, a preset charge bias begins to be applied to the charge roller 2. Thus, as a given portion of the peripheral surface of the drum 1 comes into contact with the charge roller 2, it is uniformly charged to a preset polarity and a potential level. Then, the uniformly charged portion of the peripheral surface of the drum 1 is scanned (exposed) by the beam L of laser light outputted from the unit 3 while being modulated with image formation signals which correspond to the yellow monochromatic image, that is, one of the four monochromatic images into which the full-color image to be formed was separated. As a result, an electrostatic latent image which reflects the pattern and gradation of the yellow monochromatic image is effected on the peripheral surface of the drum 1. Then, this electrostatic latent image is developed into a monochromatic yellow image, that is, a visible image formed of yellow developer, by the yellow cartridge 4*y* which is under the control of the control circuit 101. Then, the developed image, that is, the image formed of the yellow developer, is transferred (first transfer) onto the surface of the belt 5*a*, in the first transfer nip T1, by the preset first transfer bias applied to the roller 5*d* from an electric power source (unshown) with a preset control timing. The first transfer bias is preset in potential level, and is opposite in polarity to the developer. After the first transfer, the peripheral surface of the drum 1 is cleaned by the cleaning device 6.

As the transfer of the image formed of the yellow toner onto the belt 5*a* is completed, the charging, exposing, and developing processes for forming a monochromatic image on the peripheral surface of the drum 1 are carried out to form on the peripheral surface of the drum 1, an image of the developer of the magenta color, which is one of the primary color components of the image to be formed. Then, the image formed of the developer of the magenta color is transferred (first transfer) onto the belt 5*a* in such a manner it vertically aligns with the yellow developer image on the belt 5*a*.

As the transfer (first transfer) of the image formed of the magenta developer is completed, the charging, exposing, and developing processes are carried out to form on the peripheral surface of the drum 1, an image of the developer of the cyan color, which is one of the primary color components into which the full-color image to be formed was separated. Then, this image formed of the developer of the cyan color is transferred (first transfer) onto the belt 5*a* in such a manner that it is layered in alignment with the monochromatic yellow and magenta developer images which have just been transferred in layers onto the belt 5*a*.

As the transfer (first transfer) of the image formed of the cyan developer is completed, the charging, exposing, and developing processes are carried out to form on the peripheral surface of the drum 1, an image of the developer of the black color, which is one of the primary color components into which the full-color image to be formed was separated. Then, this image formed of the developer of the black color is transferred (first transfer) onto the belt 5*a* in such a manner that it is layered on the monochromatic yellow, magenta, and cyan developer images which have just been transferred in layers onto the belt 5*a*, in alignment with the monochromatic yellow, magenta, and cyan images.

Consequently, an unfixed full-color image comprises yellow, magenta, cyan, and black monochromatic images. Incidentally, the order in which four monochromatic images, different in color, are formed does not need to be limited to the order in which they are formed in this embodiment (y→m→c→k). That is, the order is optional. Before the leading edge of the unfixed full-color image made up of the four monochromatic images, different in color, on the belt 5, is made to reach the second position of the roller 10 by the movement of the belt 5*a*, the roller 11 is moved to its second position in which the roller 11 is in contact with the belt 5*a* and is capable of transferring developer images. Further, cleaning device 5*e* also is moved to its second position, or the position in which the cleaning device 5*e* can clean the belt 5*a*, with preset control timing.

Meanwhile, the sheet feeder roller 8 of the sheet feeding portion 7 begins to be driven. As the roller 8 is driven, one of the sheets S of recording medium in the cassette 9 is fed into the main assembly 100A while being separated from the rest. The cassette 9 is removably mountable in the main assembly 100A from the front side of the main assembly 100A (front loading). After being fed into the main assembly 100A, the sheet S of recording medium is introduced by a pair of registration rollers 10, into the aforementioned second transfer nip T2, which is the area of contact between the roller 11 and belt 5*a*, with a preset control timing. To the roller 11, a second transfer bias, which is opposite in polarity to the developer and is preset in potential level, is applied from an electric power source (unshown) of the main assembly 100A. Thus, as the sheet S of recording medium is conveyed through the second transfer nip T2 while remaining pinched by the belt 5*a* and transfer roller 11, the unfixed full-color image, which is made up of the four monochromatic images which are different in color, is transferred (second transfer) onto the surface of the sheet S of recording medium, as if being peeled away from the belt 5*a*, starting from the leading edge in terms of the recording medium conveyance direction.

Then, the sheet S of recording medium is separated from the surface of the belt 5*a*, and is introduced into a fixing device 12, which is used for fixing (solidly adhering while mixing) the four developer images, different in color, on the sheet S, to the surface of the sheet S. The fixing device 12 has: a rotatable heat roller 12*a*; and a rotatable pressure roller 12*b* which is kept pressed upon the heat roller 12*a* to apply heat and pressure to the sheet S. More specifically, as the sheet S of recording medium, onto which the developer images have just been transferred from the belt 5*a*, is conveyed through the fixing device 12 while remaining pinched by the pair of fixation rollers, that is, the heat roller 12*a* and pressure roller 12*b*, heat and pressure are applied to the sheet S and the developer images thereon, whereby the four monochromatic toner images, different in color, on the sheet S are fixed to the surface of the sheet S. Then, the sheet S is conveyed out of the fixing device 12, and then, is discharged as a full-color print (copy) into a delivery tray 14 by a pair of discharge rollers 13. Incidentally, when the image forming apparatus 100 is in the monochromatic image formation mode, the image forming operation is carried out using only the black cartridge 4*k*.

(Method for Replacing Cartridge)

As the development cartridges 4 (4*y*, 4*m*, 4*c*, and 4*k*) are used for image formation, the developer (toner) in each cartridge is consumed. Thus, the image forming apparatus 100 is provided with a means (unshown) for detecting the amount of the developer remaining in each development cartridge 4. The detected amount of the developer in each development cartridge 4 is compared by the control circuit 101 with a threshold value for warning an operator of the image forming apparatus 100, of the nearing of the end of the preset length of the service life of the cartridge, or the actual end of the service life. Then, if the detected amount of the developer remainder in any of the development cartridges became less than the threshold value, the information regarding the predicted remaining length of the service life of this development cartridge, or the arrival of the end of the service life of this development cartridge, is displayed on the display portion 104 of the apparatus 100 or host apparatus 200, prompting thereby the operator to prepare a replacement for this development cartridge so that the level of quality at which the apparatus 100 outputs images remains at a preset level.

In this embodiment, for the usability in terms of the replacement of the development cartridges 4 and drum cartridge 50, the apparatus 100 is structured so that the development cartridges 4 and drum cartridge 50 in the main assembly 100*a* can be accessed from the front side of the apparatus 100. More concretely, the opening 106 through which the cartridges 4 are inserted into, or removed from, the cartridge chamber 105 in the main assembly 100 A is on the front side of the main assembly 100A. Further, the front side of the main assembly 100A is provided with a door (front) 102, which is rotationally movable between the position in which the door 102 keeps the opening 6 completely covered, and the position in which the door 102 keeps the opening 6 fully exposed. In this embodiment, the door 102 is hinged to the front end of the right frame 107R of the main assembly 100A, and can be rotatably moved about the hinge 108 to expose or cover the opening 106. That is, the door 102 can be rotationally moved about the hinge 108 to cover the opening 106 of the main assembly 100*a* as shown in FIG. 1A, or can be rotationally moved rightward about the hinge 108 to fully expose the opening 106 as shown in FIG. 1B. Designated by a referential code 102*a* is a handle of the door 102. As the door 102 is opened, the cartridge chamber 105 is exposed, exposing thereby the downstream end of each development cartridge 4 in terms of the development cartridge insertion direction, as shown in FIG. 1B. Further, the handle 55 of the drum cartridge 50, which is attached to the downstream end of the bottom plate 54 of the frame 51 in terms of the drum cartridge insertion direction A, is exposed.

When the door 102 is fully open, the first to fourth development cartridges 4*y*, 4*m*, 4*c*, and 4*k* can be sequentially removed from the main assembly 100A, starting from the top one. As for the drum cartridge 50, it can be removed from the main assembly 100A together with all the development cartridges 4*y*, 4*m*, 4*c*, and 4*k*, or can be removed alone after the removal of all the development cartridges 4. Obviously, the drum cartridge 50 and development cartridges 4*y*, 4*m*, 4*c*, and 4*k* can be mounted into the main assembly 100A in the opposite order from the above-described order in which they can be removed.

(Drum Cartridge)

Figure 2B:
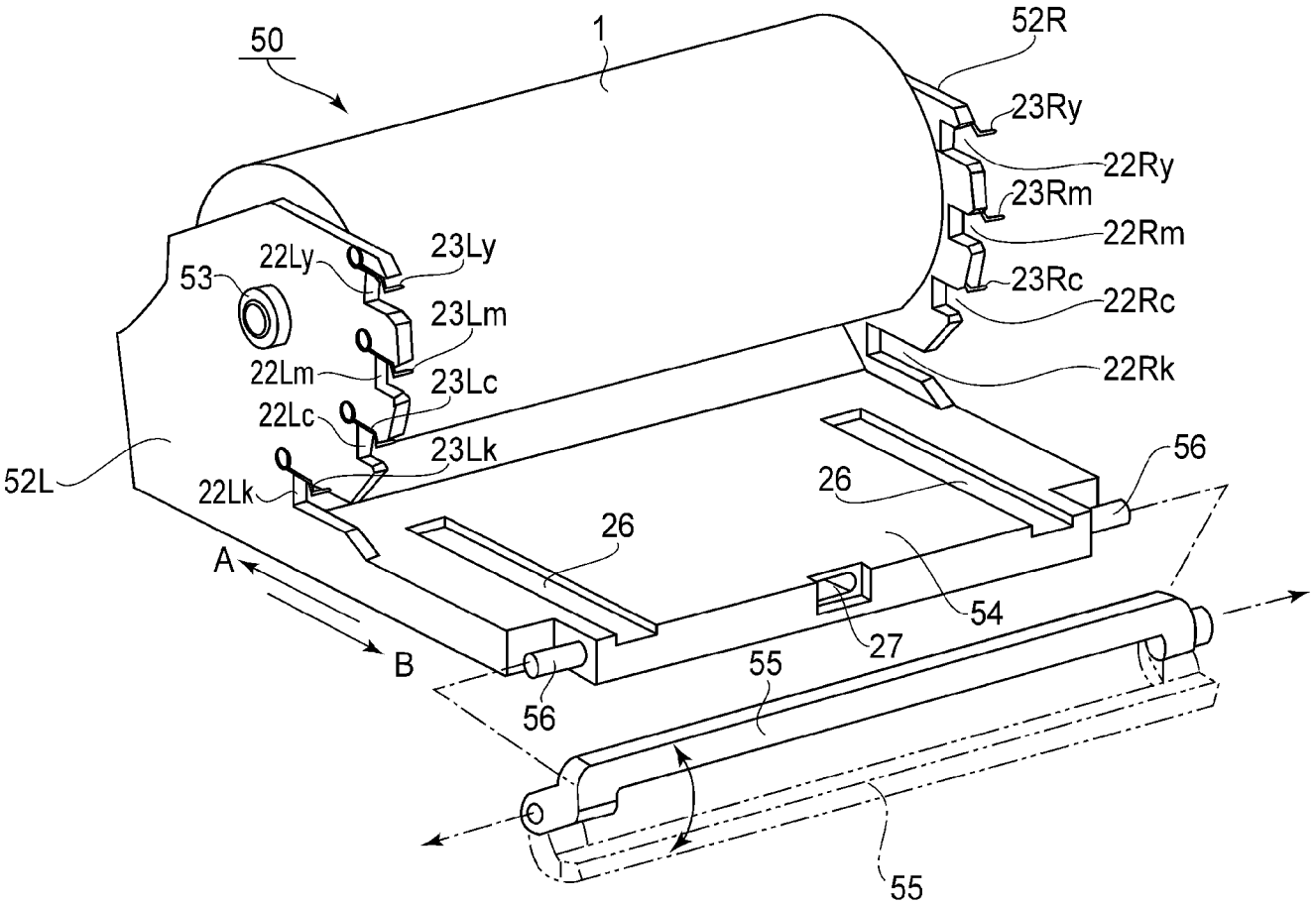
FIG. 2B is an external perspective view of the drum unit of the image forming apparatus in the first preferred embodiment of the present invention.

Next, the structure of the drum cartridge 50 is described along with the portion of the main assembly structure, which is used for allowing the drum cartridge 50 to be removably mounted in the main assembly. FIG. 2B is a perspective view of the cartridge 50. The cartridge 50 in this embodiment comprises: the frame 51; drum 1; charge roller 2 as a means for processing the drum 1; and cleaning device 6 as a means for processing the drum 1. The drum 1 and processing means (charge roller 2 and cleaning device 6) are attached to the frame 51 so that a preset positional relationship can be maintained among them. More specifically, the drum 1 is rotatably supported between the left and right plate 52L and 52R, respectively, of the frame 51, by the left and right bearings 53 (right bearing is unshown) attached to the left and right plate 52L and 52R, respectively. The left and right bearings 53 perpendicularly project outward from the outward surfaces of the 52L and 52R, one for one, and function as cartridge positioning portions. The bottom plate 54 of the frame 51 roughly horizontally extends from the main portion of the frame 51 in the opposite direction B (cartridge removal direction) to the cartridge insertion direction A. The afore-mentioned handle 55 is on the upstream end of the bottom plate 54, in terms of the drum cartridge insertion direction A, and is rotationally movable about the left and right shafts 56. The handle 55 can be switched in position between the upright position (drawn in solid line in FIG. 2B) into which it is folded, and the horizontal position (drawn in two-dot chain line in FIG. 2B) in which it protrudes frontward of the main assembly 100A so that it can be grasped by an operator to pull the drum cartridge 50 out of the main assembly 100A.

The bottom plate 54 is provided with a pair of grooves 26, which are on the top side of the bottom plate 54. The grooves 26 are for guiding the black cartridge 4*k*, or the bottommost cartridge, when the cartridge 4*k* is mounted into, or removed from, the main assembly 100A. They are in the adjacencies of the left and right edges of the bottom plate 54, and extend in the cartridge insertion-removal direction A<<B. The bottom plate 54 is also provided with a positioning hole 27, which is at the upstream end of the bottom plate 54 in terms of the cartridge insertion direction, and at the center of the bottom plate 54 in terms of the left-right direction. Further, the left and right plate 52L and 52R are provided with four recesses for positioning the development cartridges 4 relative to the drum cartridge 50 (drum 1) as the cartridges 4 are mounted into the main assembly 100A. More specifically, the left plate 52L is provided with recesses 22Ly, 22Lm, 22Lc, and 22Lk, listing from the top, for positioning the development cartridges 4*y*, 4*m*, 4*c*, and 4*k*, respectively, whereas the right plate 52R is provided with recesses 22Ry, 22Rm, 22Rc, and 22Rk, listing from the top, for positioning the development cartridges 4*y*, 4*m*, 4*c*, and 4*k*, respectively. Further, the left plate 52L is provided with development cartridge positioning-and-retaining springs 23Ly, 23Lm, 26Lc, and 26Lk, which are at the top edges of the recesses 22Ly, 22Lm, 22Lc, and 22Lk, respectively, whereas the right plate 52R is provided with development cartridge positioning-and-retaining springs 23Ry, 23Rm, 26Rc, and 26Rk, which are at the top edges of the recesses 22Ry, 22Rm, 22Rc, and 22Rk, respectively.

Figure 3A:
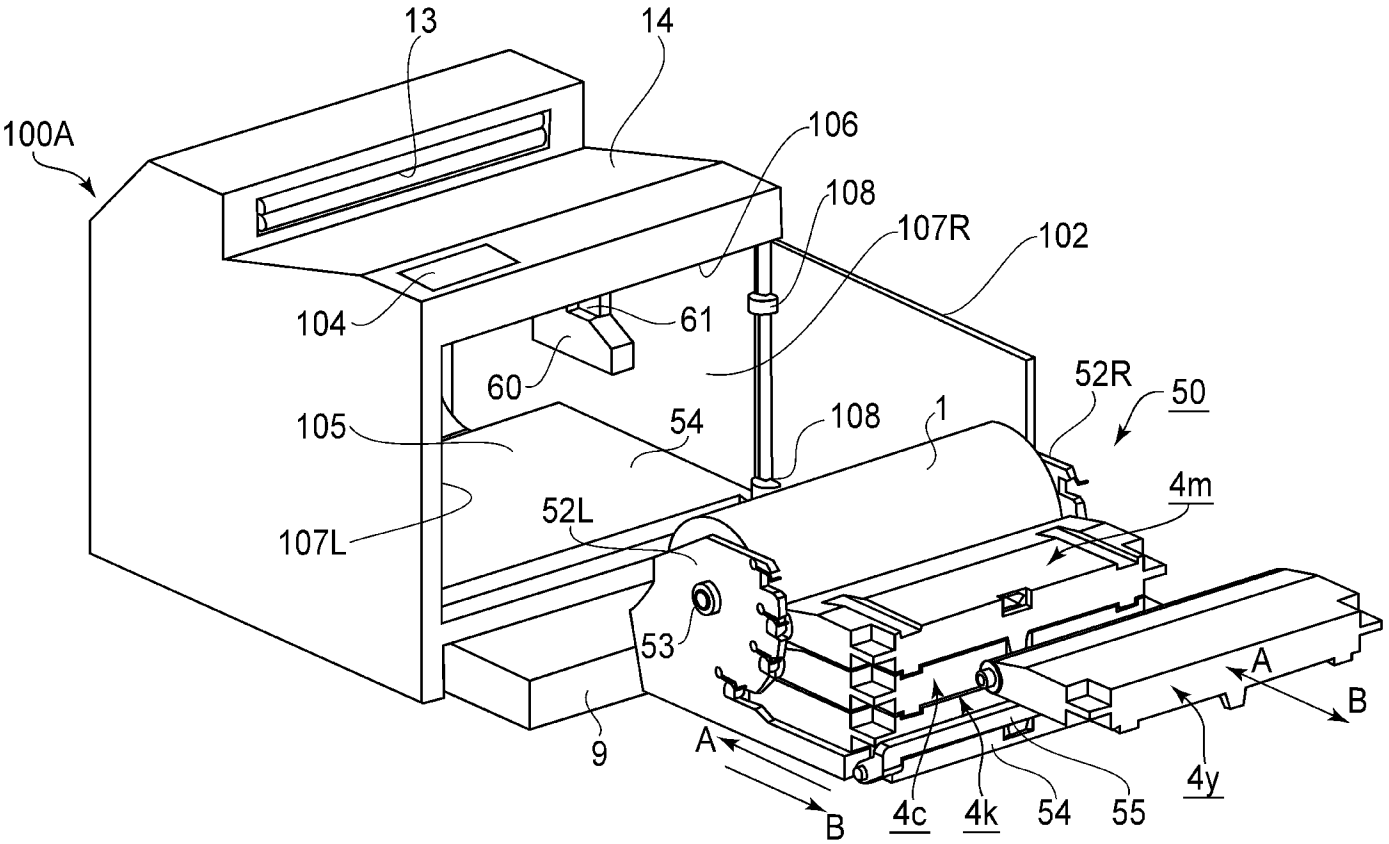
FIGS. 3A and 3B are drawings for describing how the drum unit and development cartridges are mounted into, or removed from, the main assembly of the image forming apparatus.
Figure 3B:
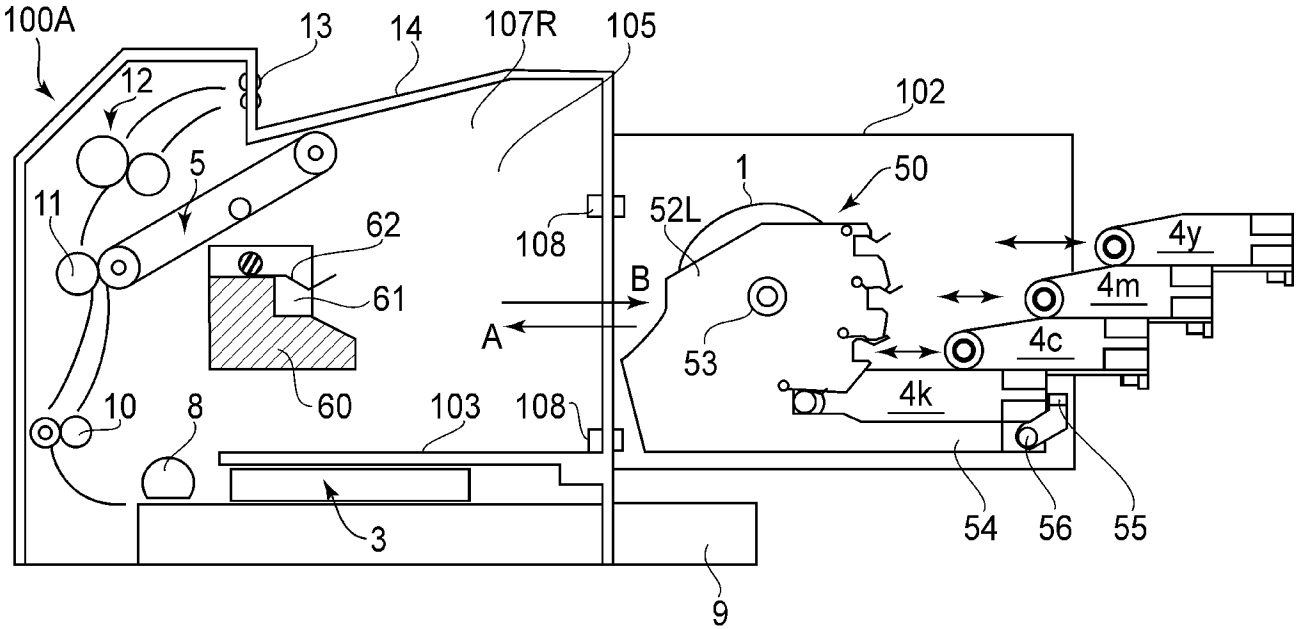
Figure 4A:
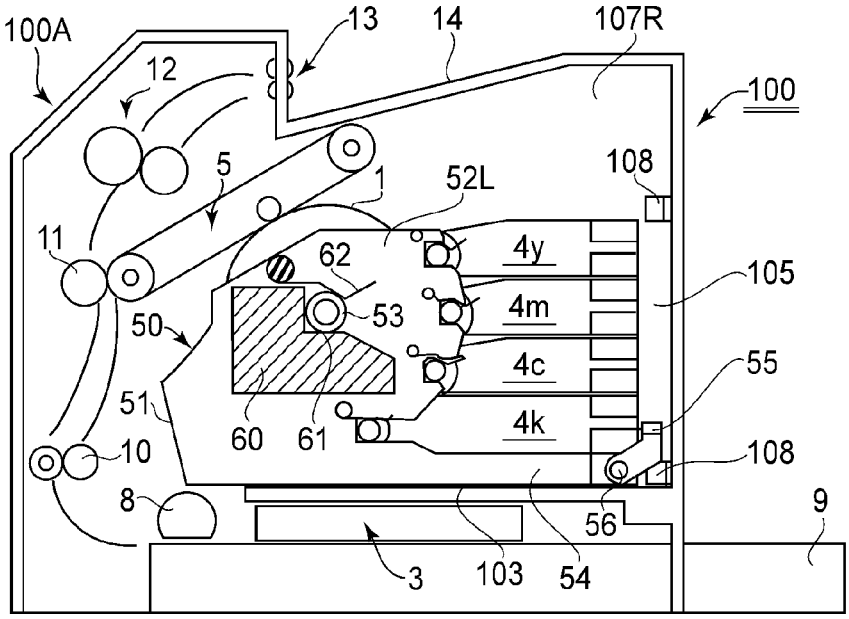
FIG. 4A is a schematic vertical sectional view of the image forming apparatus in the first preferred embodiment of the present invention when the drum unit and development cartridges are properly positioned in the main assembly of the image forming apparatus.
Figure 4B:
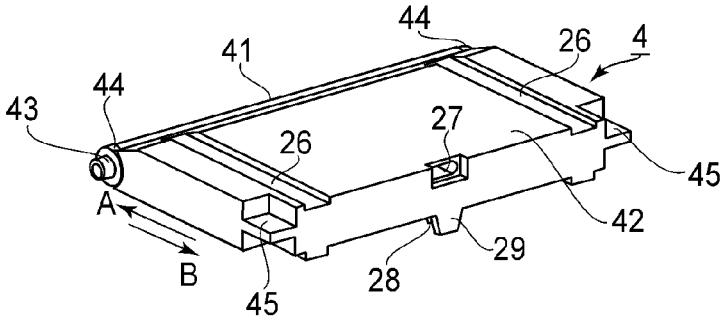
FIGS. 4B and 4C are external perspective views of the development cartridge in the first preferred embodiment as seen from the top and bottom sides, respectively, of the cartridge.
Figure 4C:
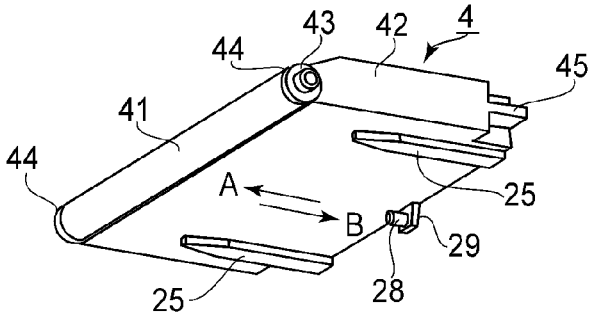

As for the cartridge chamber 105, each of the left and right frames 107L and 107R is provided with a drum cartridge guiding member 60 (drum cartridge guide of main assembly 100A), which is on the inward surface of each frame 107 as shown in FIGS. 3A, 3B, and 4A. The two drum cartridge members 60 are symmetrically positioned with reference to the vertical plane which coincides with the center of the main assembly 100A and is parallel with the cartridge insertion direction A. Further, each of the left and right drum cartridge guiding members 60 is provided with a drum positioning recess 61 (drum cartridge positioning portion of main assembly 100A), into which the corresponding drum bearing 53 (as drum cartridge positioning portion of drum cartridge 50) fits. Further, each of the left and right guides 60 is provided with a spring 62 for keeping the drum bearing 53 retained in the drum positioning recess 61.

The operational sequence for mounting the cartridge 50 into the main assembly 100A is as follows: First, an operator is to hold the cartridge 50 by the left and right end portions of the cartridge 50, insert the cartridge 50 from the drum side, into the cartridge chamber 105 of the main assembly 100A through the opening 106, so that the bottom surface of the bottom plate 54 of the frame 51 comes into contact with the top surface of the bottom frame 103 of the main assembly 100A. Then, the operator is to slide the cartridge 50 rearward of the main assembly 100A, in such a manner that the cartridge 50 is guided by the top surface of the bottom frame 103. As the cartridge 50 is inserted close to the deepest end of the cartridge chamber 105, the left and right drum bearings 53 (as cartridge positioning portions of cartridge 50) enter the recesses 61 of the left and right cartridge guiding members 60, one for one, while pushing up the springs 62 against the resiliency of the springs 62. Then, each bearing 53 comes into contact with the vertical wall (bearing catching wall) of the corresponding recess 61, thereby preventing the cartridge 50 from being inserted further. From this point on, the bearing 53 is retained in the recess 61 by the resiliency of the spring 62. Thus, the cartridge 50 becomes precisely positioned relative to the cartridge chamber 150 in terms of the front-rear, left-right, and vertical directions. The operational sequence for removing the cartridge 50 out of the cartridge chamber 150 is as follows: The operator is to rotationally move the handle 55 so that it becomes roughly horizontal and extends upstream from the upstream end of the bottom plate 54, in terms of the cartridge insertion direction A. Then, the operator is to pull the cartridge 50 by grasping the handle 55 frontward of the main assembly 100A (cartridge removal direction B) against the resiliency of the springs 62. As the cartridge 50 is pulled, the left and right bearings 53 slip out of the corresponding recesses 61 while pushing the springs 62 upward against the resiliency of the springs 62. That is, the bearings 53 are freed from the recesses 61. Then, as the cartridge 50 is pulled out further by the operator by the handle 55, the cartridge 50 slides frontward of the main assembly 100A, on the top surface of the frame 103, while being guided by the frame 103. This is how the cartridge 50 can be moved out of the main assembly 100A through the opening 106.

(Development Cartridge)

Next, the structure of the development cartridge 4 is described along with the portion of the structure of the main assembly 100A, which is used for mounting the development cartridges 4 into the main assembly 100A or removing the development cartridges 4 from the main assembly 100A. In this embodiment, the development cartridges 4*y*, 4*m*, 4*c*, and 4*k* have development rollers 41*y*, 41*m*, 41*c*, and 41*k*, respectively, which are used for supplying the drum 1 with developer. Further, each development cartridge 41 has a frame 42 (developer chamber) in which the developer to be used for developing an electrostatic latent image is stored. The development cartridge frame 42 is flat and parallelepipedic. Further, each development cartridge frame 42 contains: a coating member for coating the peripheral surface of the roller 41 with developer; a development blade which not only regulates the coated developer on the peripheral surface of the roller 41 in terms of the thickness of the uniform layer into which the coated developer is formed, but also, charges the developer as it regulates the coated developer; a member which conveys the developer while stirring the developer; etc., which are not illustrated in the drawings. The roller 41 is rotatably supported between the left and right plates of the frame 42 by the left and right bearings 43 which are at the downstream end of the frame 42 in terms of the development cartridge insertion direction. The positional relationship between the roller 41 and frame 42 is such that roughly half the peripheral surface of the roller 41, in terms of the circumferential direction of the roller 41, is exposed from the frame 42, and the other half is inside the frame 42. Each of the left and right ends of the roller 41 is fitted with a spacer ring 44 for regulating the gap between the peripheral surface of the roller 41 and the peripheral surface of the drum 1. The spacer ring 44 is coaxial with the roller 41. The spacer ring 44 is greater in diameter by a preset amount than the roller 41. Further, the frame 42 is provided with a pair of handgrips 45, which are at the left and right upstream ends of the frame 42 in terms of the cartridge insertion direction. The frame 42 is also provided with a cartridge positioning recess 27 and a cartridge positioning projection 28. The recess 27 is at the top center of the upstream end of the frame 42. The projection 28 is at the bottom center of the upstream end of the frame 42. More specifically about the positioning projection 28, the frame 42 is provided with a small plate 29 which perpendicularly projects downward from the bottom center of the upstream end of the frame 42. The cartridge positioning projection 28 perpendicularly projects in the cartridge insertion direction A from the inward surface of the small plate 29. Further, the top wall of the frame 42 is provided with a pair of guiding grooves 26 for guiding the cartridge 4 which is directly above. The guiding grooves 26 extend along the left and right edges of the frame 42, that is, in the cartridge insertion-removal direction A<<B. The frame 42 is also provided with a pair of guiding ridges 25 which fit, one for one, in the guiding grooves 26 of the cartridge 4 which is directly below. The guiding ridges 25 also extend in the cartridge insertion-removal direction A ↔ B. The guiding grooves 26 and guiding ridges 25 are for guiding each cartridge 4 when each cartridge 4 is engaged with the drum cartridge 50, and also, when each cartridge 4 is disengaged from the drum cartridge 50.

(Engagement of Development Cartridge with Drum Cartridge)

Figure 5A:
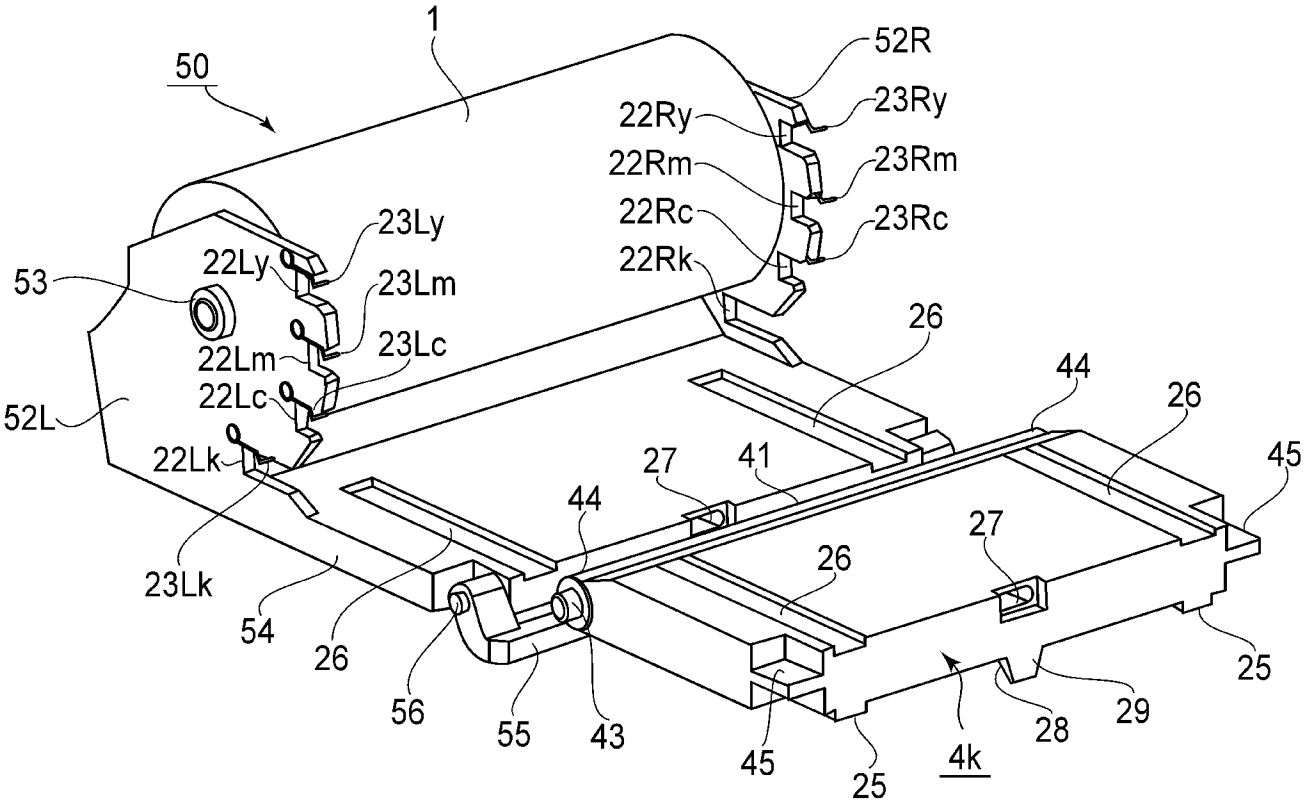
FIGS. 5A and 5B are a drawing for illustrating how development cartridges are engaged with the drum cartridge.

The first, second, third, and fourth development cartridges 4 (4*y*, 4*m*, 4*c*, and 4*k*) are to be engaged with the drum cartridge 50 in the order of the fourth, third, second, and first. Referring to FIG. 5A, the black cartridge 4, or the bottommost cartridge, is to be positioned directly on the bottom plate 54 of the frame 51. It is to be inserted into the cartridge chamber 150 of the main assembly 100A from the development roller side, with its left and right guiding ridges 25 on its bottom surface fitted in the left and right guiding grooves 26, respectively, in the top surface of the bottom plate 54. Regarding the attitude of the handle 55, when the development cartridge 4*k* is inserted into the cartridge chamber 150, the handle 55 is to be kept horizontal to prevent the handle 55 from interfering with the cartridge 4*k*. With the guiding ridges 25 engaged in the guiding grooves 26, the operator is to push the cartridge 4*k* in the cartridge insertion direction A to cause the cartridge 4*k* to slide, on the bottom plate 54, inward of the frame 51. As the cartridge 4*k* is pushed inward of the frame 51, the left and right bearings 43 of the cartridge 4*k* engage into the recesses 22Lk and 22Rk of the left and right plate 52L and 52R of the cartridge 50, respectively. Then, the left and right bearings 43 are immediately pressed by the springs 23Lk and 23Rk in the cartridge insertion direction A, whereby the development roller 41*k* is precisely positioned relative to the drum 1. Therefore, the cartridge 4*k* is kept pressed in the cartridge insertion direction A, whereby the development roller 41*k* is kept precisely positioned relative to the drum 1. In this embodiment, as the left and right bearings 43 are pressed by the left and right springs 23Lk and 23Rk, the left and right spacer rings 44 are placed in contact with the left and right end portions of the drum 1, whereby a preset distance is maintained between the rotational axis of the drum 1 and that of the roller 41*k*, and therefore, the peripheral surface of the roller 41*k* is kept a preset microscopic distance away from the peripheral surface of the drum 1. In other words, in this embodiment, the so-called non-contact developing method is employed. However, the application of the present invention is not limited to an electrophotographic image forming apparatus which employs the non-contact developing method. That is, the present invention is also applicable to an electrophotographic image forming apparatus which employs the contact developing method, that is, the developing method which places the roller 41 and drum 1 in contact with each other for development. Going back to the description of this embodiment, as the cartridge 4*k* is inserted inward of the frame 51, the projection 28 of the cartridge 4*k* fits into the recess 27 of the bottom plate 54, whereby the cartridge 4*k* is correctly set in its attitude relative to the cartridge 50; in other words, the cartridge 4*k* is precisely positioned relative to the drum cartridge 50 in terms of the cartridge insertion direction, left-right direction, and vertical direction.

As for the mounting of the cyan cartridge 4*c* which is to be mounted on the cartridge 4*k* which is already in engagement with the drum cartridge 50, first, the cartridge 4*c* is to be inserted into the cartridge chamber 150 from the roller (4*c*) side, in such a manner that the left and right guiding ridges 25 of the cartridge 41*c*, which are on the bottom surface of the cartridge 41*c*, fit into the left and right guiding grooves 26 of the cartridge 4*k*, which are in the top surface of the cartridge 4*k*. Then, with the ridges 25 engaged in the grooves 26, the operator is to push the cartridge 4*c* in the cartridge insertion direction A so that the cartridge 4*c* slides on the cartridge 4*k*, inward of the frame 51. As the cartridge 4*c* is pushed inward of the frame 51, the left and right bearings 43 of the cartridge 4*c* fit into the recesses 22Lc and 22Rc of the left and right plates 52L and 52R of the cartridge 50, respectively, and are pressed by the springs 23Lc and 23Rc in the cartridge insertion direction A, whereby the roller 41*c* is precisely positioned relative to the drum 1. Further, the projection 28 of the cartridge 4*c* fits into the recess 27 of the cartridge 4*k*, whereby the cartridge 4*c* is precisely set in terms of its attitude relative to the cartridge 50. That is, the cartridge 4*c* is precisely position in terms of the cartridge insertion direction, left-right direction, and vertical direction.

Figure 5B:
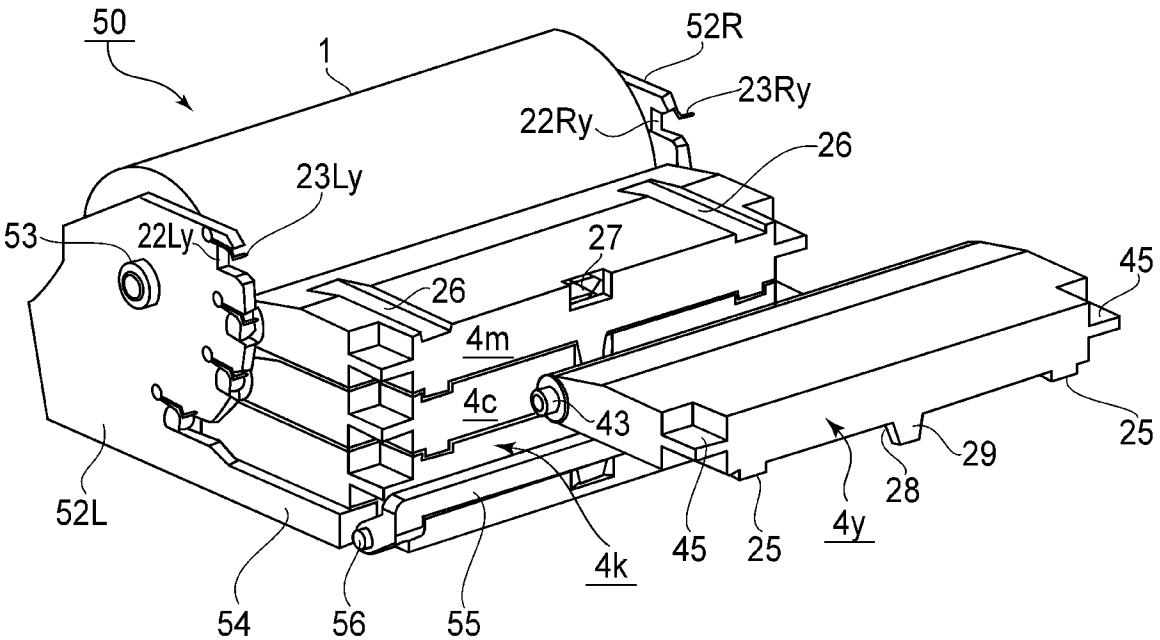

As for the mounting of the magenta cartridge 4*m* which is to be mounted on the cartridge 4*c* which is already in engagement with the drum cartridge 50, first, the cartridge 4*m* is to be inserted into the cartridge chamber 150 from the roller (41*m*) side, in such a manner that the left and right guiding ridges 25 of the cartridge 41*m*, which are on the bottom surface of the cartridge 41*m*, fit into the left and right guiding grooves 26 of the cartridge 4*c*, which are in the top surface of the cartridge 4*c*. Then, with the ridges 25 engaged in the grooves 26, the operator is to push the cartridge 4*m* in the cartridge insertion direction A so that the cartridge 4*m* slides on the cartridge 4*c*, inward of the frame 51. As the cartridge 4*m* is pushed inward of the frame 51, the left and right bearings 43 of the cartridge 4*m* fit into the recesses 22Lm and 22Rm of the left and right plates 52L and 52R of the cartridge 50, respectively, and are pressed by the springs 23Lm and 23Rm in the cartridge insertion direction A, whereby the roller 41*m* is precisely positioned relative to the drum 1. Further, the projection 28 of the cartridge 4*m* fits into the recess 27 of the cartridge 4*c*, whereby the cartridge 4*m* is precisely set in terms of its attitude relative to the cartridge 50. That is, the cartridge 4*m* is precisely positioned in terms of the cartridge insertion direction, left-right direction, and vertical direction. FIG. 5B shows the state of the drum cartridge 50, and black, cyan, magenta, and yellow development cartridges 4*k*, 4*c*, 4*m*, and 4*y*, in which the black, cyan, and magenta development cartridge 4*k*, 4*c*, and 4*m* are already in engagement with the drum cartridge 50, whereas the development cartridge 4*y* is yet to be engaged with the drum cartridge 50.

As for the mounting of the yellow cartridge 4*y*, which is to be mounted on the cartridge 4*m* which is already in engagement with the drum cartridge 50, first, the cartridge 4*y* is to be inserted into the cartridge chamber 150 from the roller (41*y*) side, in such a manner that the left and right guiding ridges 25 of the cartridge 4*y*, which are on the bottom surface of the cartridge 4*y*, fit into the left and right guiding grooves 26 of the cartridge 4*m*, which is in the top surface of the cartridge 4*m*. Then, with the ridges 25 engaged in the grooves 26, the operator is to push the cartridge 4*y* in the cartridge insertion direction A so that the cartridge 4*y* slides on the cartridge 4*m*, inward of the frame 51. As the cartridge 4*y* is pushed inward of the frame 51, the left and right bearings 43 of the cartridge 4*y* fit into the recesses 22Ly and 22Ry of the left and right plates 52L and 52R of the cartridge 50, respectively, and are pressed by the springs 23Ly and 23Ry in the cartridge insertion direction A, whereby the roller 41*y* is precisely positioned relative to the drum 1. Further, the projection 28 of the cartridge 4*y* fits into the recess 27 of the cartridge 4*m*, whereby the cartridge 4*y* is precisely set in terms of its attitude relative to the cartridge 50. That is, the cartridge 4*y* is precisely positioned in terms of the cartridge insertion direction, left-right direction, and vertical direction.

Incidentally, there are various ways to mount the drum cartridge 50 and development cartridges 4 into the main assembly 100A. For example, the drum cartridge 50 and four development cartridges 4 can be mounted together after the four development cartridges 4 are engaged with the drum cartridge 50, or the four development cartridges 4 may be mounted following the above-described procedure, after the mounting of the drum cartridge 50. When it is necessary to replace only one or more development cartridges 4, the second method is to be used. As for the method for taking the drum cartridge 50 and development cartridge 4 out of the main assembly 100A, there are also various methods. That is, first, the door 102 is to be opened. Then, the drum cartridge 50 and four development cartridges 4 can be taken together out of the main assembly 100A, by pulling the drum cartridge 50 by the handle 55, or the development cartridges 4 can be pulled out of the main assembly 100A one by one, starting from the top development cartridge 4, by grasping the handle 45, while leaving the drum cartridge 50 mounted.

In this embodiment, each development cartridge 4 is precisely positioned relative to the drum cartridge 50 which is holding the drum 1. Therefore, it is assured that the roller 41 is precisely aligned, and kept aligned, relative to the drum 1. Further, it is possible to insert the drum cartridge 50 and development cartridges 40 together into the main assembly 100A, or remove them together from the main assembly 100A. That is, the main assembly 100A, drum cartridge 50, and development cartridges 4 are structured so that multiple development cartridges 4 can be removed from the drum cartridge 50 in the main assembly 100A, or the drum cartridge 50 in the main assembly 100A can be removed with the development cartridges 4. Further, the top surface of the bottom plate 54 of the frame 51 of the drum cartridge 50, and the top surface of each of the development cartridge 4*k*, 4*c*, and 4*m* is provided with guiding grooves 26 for guiding the development cartridge 4 which is immediately above, when the cartridges 4 are inserted, whereas the bottom surface of each development cartridge 4 is provided with the pair of guiding ridges 25, by which the development cartridge 4 is guided when it is inserted into the cartridge chamber 150. When the development cartridges 4 are to be mounted into the main assembly 100A, they are to be sequentially mounted into the main assembly 100A, and are to be sequentially engaged with the drum cartridge 50, starting from the development cartridge 4*k*, or the bottommost development cartridge. Since the drum cartridge 50 and development cartridges 4 are structured so that the development cartridge 4*m* is provided with the cartridge guiding grooves 26, by which the cartridge guiding ridges 25 of the cartridge 4*y* are guided to guide the cartridge 4*y*; the cartridge 4*c* is provide with the cartridge guiding grooves 26, by which the cartridge guiding ridges 25 of the cartridge 4*m* are guided to guide the cartridge 4*m*; the cartridge 4*k* is provide with the cartridge guiding grooves 26, by which the cartridge guiding ridges 25 of the cartridge 4*c* are guided to guide the cartridge 4*c*; and the bottom plate 54 of the drum cartridge 50 is provided with the cartridge guiding grooves 26, by which the cartridge guiding ridges 25 of the cartridge 4*k* are guided to guide the cartridge 4*k*. Therefore, the development cartridges 4 in this embodiment are significantly less in thickness than any of conventional development cartridges. In other words, the application of the present invention leads to the reduction in the size of the main assembly of an electrophotographic image forming apparatus.

Embodiment 2

Figure 6A:
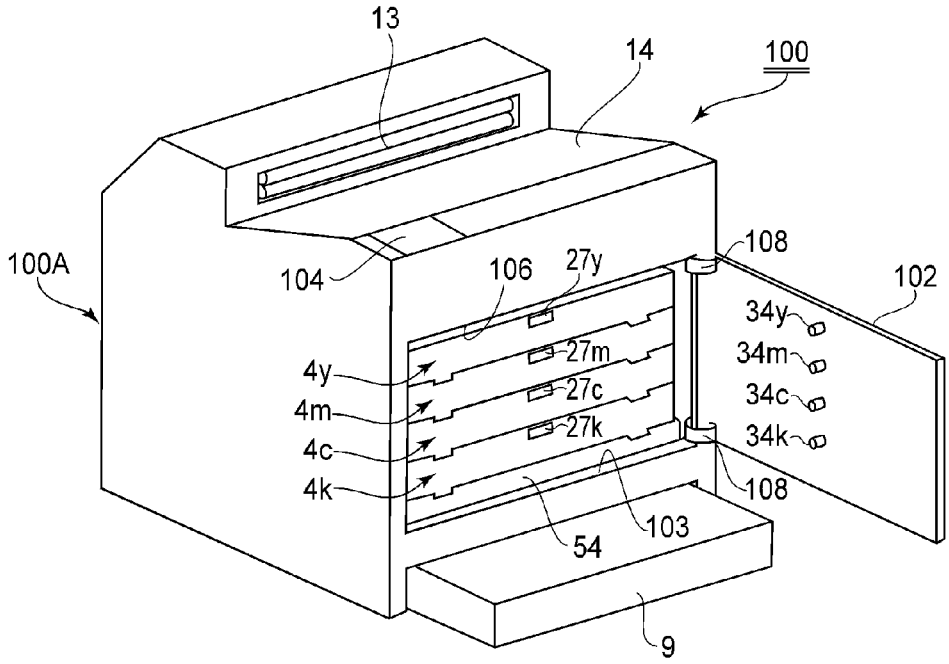
FIG. 6A is a schematic perspective view of the electrophotographic color image forming apparatus in the second preferred embodiment of the present invention.

FIG. 6A is a drawing for describing the apparatus 100 in the second preferred embodiment of the present invention. The apparatus 100 in this embodiment is basically the same as the apparatus 100 in this first preferred embodiment. That is, the drum cartridge 50 is precisely positioned relative to the main assembly 100A, and each development cartridge 4 is precisely positioned relative to the drum cartridge 50. Further, the drum cartridge 50 and development cartridges 40 can be mounted together into the main assembly 100A, or removed together from the main assembly 100A. This embodiment differs from the first embodiment as follows. The door 102 has four projections 28 (28*y*, 28*m*, 28*c*, and 28*k*) which are used for precisely positioning the development cartridges 4, one for one, to correctly set the cartridges 4 in attitude. The four projections 34 perpendicularly project from the inward surface of the door 102. Thus, as the door 102 is closed, the four projections 28 fit into the cartridge positioning holes 27 (27*y*, 27*m*, 27*c*, and 27*k*) of the four development cartridges 4, which are at the downstream ends of the cartridges 4 in terms of the cartridge insertion direction A. The position of the each cartridge 4 in terms of the rotational direction of the development roller 41 in the cartridge 4 is roughly set by the cartridge 4 or cartridge 50 which is immediately below. Thus, as the door 102 is closed, the four projections 34 fit into the holes 27 of the cartridges 4, one for one, whereby the cartridges 4 are precisely positioned relative to the main assembly 100A and drum cartridge 50.

Also in this embodiment, the drum cartridge 50 and development cartridges 4 can be inserted together into the main assembly 100A, or removed together from the main assembly 100*a* in the same manner as the counterparts in the first embodiment can. Further, the members for guiding the development cartridges 4 when the cartridges 4 are inserted into the main assembly 100A are integral parts of the cartridges 4. Therefore, the main assembly 100A does not need to be provided with the members or portions for guiding the development cartridges 4 when the cartridges 4 are inserted into, or removed from, the main assembly 100A. Thus, the image forming apparatus 100 in this embodiment is significantly narrower compared to any of conventional electrophotographic image forming apparatuses. In other words, the present invention can provide an electrophotographic image forming apparatus which is significantly narrower than any of conventional electrophotographic image forming apparatuses. Further, in the case of the image forming apparatus 100 in this embodiment, it is by the door 102 that the development cartridges 4 are precisely positioned. Therefore, it is not mandatory that the development cartridges 4 are placed in contact the adjacent ones. Thus, each development cartridge 4 is less likely to be affected by the oscillations of the other cartridges 4.

Embodiment 3

Figure 6B:
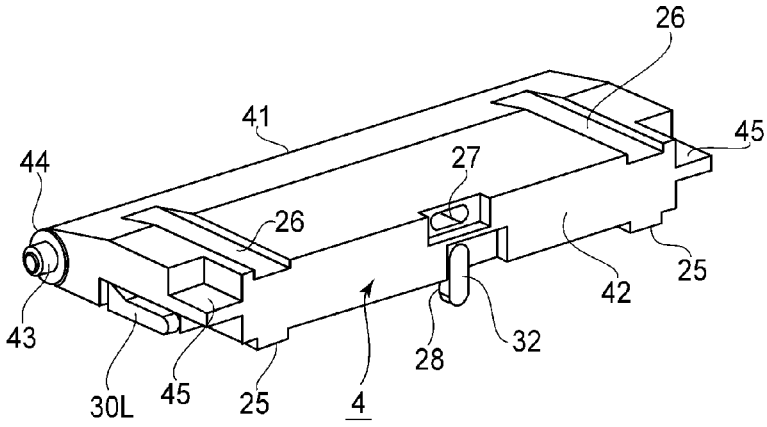
FIG. 6B is an external perspective view of the development cartridge for the electrophotographic color image forming apparatus in the third preferred embodiment of the present invention.
Figure 8A:
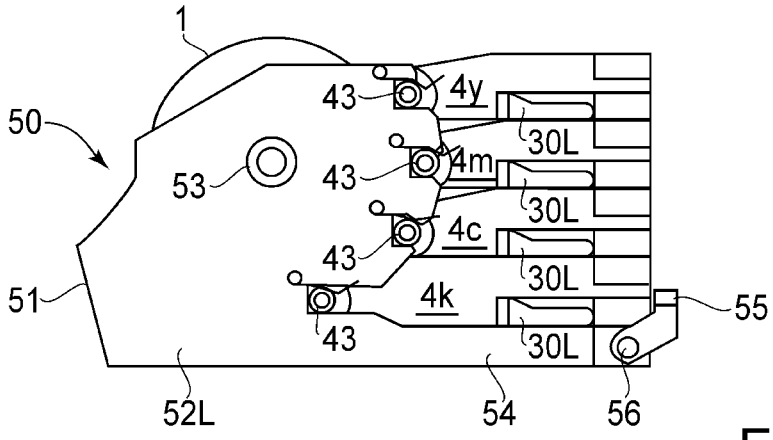
FIGS. 8A, 8B and 8C illustrate how the magenta development cartridge is mounted into, or removed from, the main assembly of the image forming apparatus, in the third preferred embodiment.
Figure 8B:
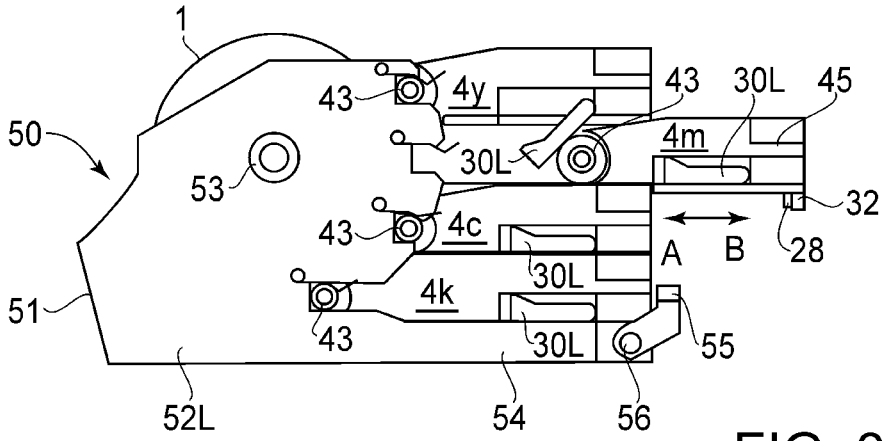
Figure 8C:
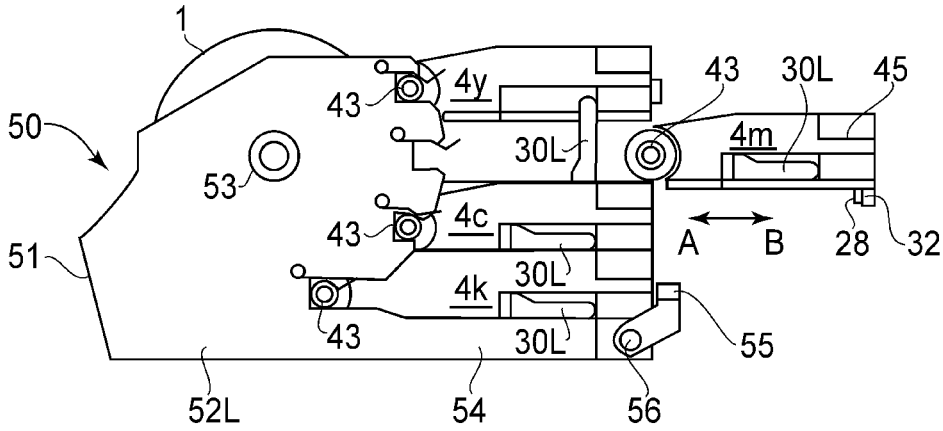

FIGS. 6B, 7, and 8 are drawings for describing the apparatus 100 in the third preferred embodiment of the present invention. Each of the four development cartridges 4 (4*y*, 4*m*, 4*c*, and 4*k*) is provided with a pair of (left and right) cartridge holding means (legs) 30 (30L and 30R) for temporarily holding the cartridge 4. Each cartridge 4 is also provided with a development cartridge positioning means 32 having a cam 31 which serves as the means for regulating the cartridge holding means (legs) 30 for temporarily holding the development cartridge 4. The left and right legs 30 are attached to a rotational shaft 33, which is in engagement with the cam 31 of the development cartridge positioning means 32 to regulate the rotational movement of the legs 30. Thus, as the development cartridge positioning means 32 is rotationally moved from the position shown in FIG. 7A into the position shown in FIG. 7(*c*), the legs 30 are freed from the control from the positioning means 32. As a result, the legs 30 are rotationally moved by the left and right springs 34L and 34R as shown in FIG. 7(*c*). FIG. 7A is an enlargement of the circled portion of FIG. 7A, and FIG. 7(*d*) is an enlargement of the circled portion of FIG. 7(*c*).

Next, referring to FIGS. 7 and 8, the method for mounting or dismounting the development cartridge 4 in this embodiment is described. If it is necessary to pull the magenta cartridge 4*m*, for example, out of the main assembly 100A, the operator is to rotationally move the cartridge positioning means 32 of the yellow cartridge 4*y* from the position shown in FIG. 7A into the position shown in FIG. 7(*c*) so that the cartridge positioning means 32 disengages from the magenta cartridge 4*m*. As the cartridge positioning means 32 of the yellow cartridge 4*y* is moved as described above, the legs 30 of the yellow cartridge 4*y* are rotationally moved by the unshown springs while being guided by the top portion of the magenta cartridge 4*m*, that is, the cartridge to be pulled out, as shown in FIG. 8B. Consequently, the legs 30L and 30R of the yellow cartridge 4*y* stand erect on the cyan cartridge 4*c*, that is, the cartridge which is immediately below the cyan cartridge 4*m*, temporarily holding the yellow cartridge 4*y*, as shown in FIG. 8(*c*). In other words, the position in which each of the legs 30 of the yellow cartridge 4*y* is as shown in FIG. 8(*c*) is the first position of the leg 30, in which the leg 30 temporarily supports the yellow cartridge 4*y* when the development cartridge 4*m*, that is, the development cartridge which is immediately below the cartridge 4*y*, needs to be removed from the main assembly 100A. Since the yellow cartridge 4*y* is temporarily supported by its legs 30 and the cyan cartridge 4*c*, the magenta cartridge 4*m*, which is between the yellow and cyan cartridges 4*y* and 4*c*, can be pulled out with no interference. On the other hand, when it is necessary to insert the magenta cartridge 4*m* into the main assembly 100A, the operator is to carry out in the reverse order, the above-described steps carried out to extract the cartridge 4*m*. That is, the operator is to insert the magenta cartridge 4*m* as shown in FIG. 8(*c*). As the cartridge 4*m* is inserted, the legs 30 of the yellow cartridge 4*y*, which are perpendicular to the cartridge 4*y* at this point, are rotationally moved upward by the magenta cartridge 4*m* as shown in FIG. 8B, until they are stored into the recesses (leg spaces) of the yellow cartridge 4*y*, as shown in FIG. 8A. The position in which the leg 30 is in FIG. 8A is the second position for the leg 30, that is, the position in which the leg 30 does not support the development cartridge to which it belongs. Then, the operator is to precisely position the magenta cartridge 4*m* with the use of the cartridge positioning means 32 of the yellow cartridge 4*y*. That is, when the legs 30 of the positioning means 32 of a given development cartridge 4 are in their second position, the positioning means 32 of the cartridge is in the position in which it can precisely position the immediately adjacent development cartridge, whereas when the legs 30 of the given development cartridge 4 are in their first position, the positioning means 32 of the development cartridge remains retracted. Therefore, the downstream end of the magenta cartridge 4*m* is precisely position relative to the main assembly 100A (drum cartridge 50), and also, the legs 30 of the yellow cartridge 4*y* do not weigh on the magenta cartridge 4*m*, that is, the cartridge which is immediately below the yellow cartridge 4*y*. The operational sequence for mounting or dismounting each of the other cartridges 4 is the same as the one for the development cartridge 4*m*.

As described above, each development cartridge 4 is provided with the pair of rotationally movable legs, and the development cartridge positioning means having the leg regulating means. Thus, no matter which development cartridge 4 is mounted into, or dismounted from, the main assembly 100A, the mechanism for temporarily holding a development cartridge automatically functions. Therefore, even if the drum cartridge 50 and/or main assembly 100A is not provided with the cartridge insertion (removal) guides, the development cartridges can be easily inserted or removed. Also in the third embodiment, development cartridges 4 are precisely positioned relative to the drum cartridge 50 (main assembly 100A) by being engaged with the drum cartridge 50, and therefore, they can be inserted together into, or removed together from, the main assembly 100A, with the drum cartridge 50.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 140473/2010 filed Jun. 21, 2010 which is hereby incorporated by reference.

What is claimed is:

1. A color electrophotographic image forming apparatus for forming a color image on a recording material, said apparatus comprising:

a main assembly;

a drum cartridge including an electrophotographic photosensitive drum and detachably mountable to said main assembly;

a plurality of developing cartridges each comprising a developing roller for developing an electrostatic latent image formed on said electrophotographic photosensitive drum;

a main assembly side drum cartridge guide for guiding said drum cartridge; and a main assembly side drum cartridge positioning portion for positioning said drum cartridge to said main assembly, wherein said drum cartridge is provided with a positioning portion for positioning a developing cartridge relative to said drum cartridge with respect to an entering direction of said developing cartridge, and said developing cartridge is provided with an insertion guide for guiding insertion of a developing cartridge right thereabove.

2. An apparatus according to claim 1, wherein said drum cartridge is removable from said main assembly integrally with said plurality of developing cartridges removably mounted to said drum cartridge.

3. An apparatus according to claim 1, further comprising a door, wherein said plurality of developing cartridges is positioned by said door.

4. An apparatus according to claim 1, further comprising a holding leg capable of holding an attitude of said developing cartridge, wherein said holding leg is movable between a first position for holding said developing cartridge when a developing cartridge right therebelow is removed from said drum cartridge and a second position not holding said developing cartridge.

5. An apparatus according to claim 4, wherein said developing cartridge having said holding leg is provided with a positioning portion for positioning said developing cartridge right therebelow, and wherein when said holding leg is in the second position, said positioning portion is in a positioning position for positioning said developing cartridge right therebelow, and when said holding leg is in the first position, said positioning portion is retracted from the positioning position.

6. A color electrophotographic image forming apparatus for forming a color image on a recording material, said apparatus comprising:

a main assembly;

a drum cartridge including an electrophotographic photosensitive drum and detachably mountable to said main assembly;

a plurality of developing cartridges each comprising a developing roller for developing an electrostatic latent image formed on said electrophotographic photosensitive drum;

a main assembly side drum cartridge guide for guiding said drum cartridge; and a main assembly side drum cartridge positioning portion for positioning said drum cartridge to said main assembly; and a holding leg capable of holding an attitude of a developing cartridge, wherein said holding leg is movable between a first position for holding said developing cartridge when a developing cartridge right therebelow is removed from said drum cartridge and a second position not holding said developing cartridge.

7. An apparatus according to claim 6, wherein said drum cartridge is removable from said main assembly integrally with said plurality of developing cartridges removably mounted to said drum cartridge.

8. An apparatus according to claim 6, further comprising a door, wherein said plurality of developing cartridges is positioned by said door.

9. An apparatus according to claim 6, wherein said drum cartridge is provided with a positioning portion for positioning said developing cartridge relative to said drum cartridge with respect to an entering direction of said developing cartridge, and is provided with insertion guide for guiding insertion of a developing cartridge right above said insertion guide.

10. An apparatus according to claim 6, wherein said developing cartridge having said holding leg is provided with a positioning portion for positioning said developing cartridge right therebelow, and wherein when said holding leg is in the second position, said positioning portion is in a positioning position for positioning said developing cartridge right therebelow, and when said holding leg is in the first position, said positioning portion is retracted from the positioning position.

11. A cartridge detachably mountable to a color electrophotographic image forming apparatus for forming a color image on a recording material, said cartridge comprising:

a holding leg capable of holding an attitude of said cartridge, wherein said holding leg is movable between a first position for holding said cartridge when a cartridge right therebelow is removed from a drum cartridge and a second position not holding said cartridge.

12. A cartridge according to claim 11, further comprising a positioning portion for positioning said cartridge right therebelow, wherein when said holding leg is in the second position, said positioning portion is in a positioning position for positioning said cartridge right therebelow, and when said holding leg is in the first position, said positioning portion is retracted from the positioning position.

13. A cartridge according to claim 11, further comprising a developing roller for developing an electrostatic latent image formed on an electrophotographic photosensitive drum.

14. An apparatus according to claim 1, wherein each of said plurality of developing cartridges includes an engaging portion, and a developing cartridge is positioned by said engaging portion engaging with another developing cartridge disposed right therebelow.

15. An apparatus according to claim 14, wherein said engaging portion is disposed in a upstream side of a developing cartridge with respect to the entering direction.

16. A developing cartridge for use with an image forming apparatus, wherein said image forming apparatus includes a drum cartridge including an electrophotographic photosensitive drum and detachably mountable to a main assembly of the image forming apparatus, said drum cartridge includes a plurality of mounting portions for mounting a plurality of developing cartridges, respectively, said developing cartridge comprises:

an insertion guide for guiding insertion of another developing cartridge right thereabove into the drum cartridge.

17. An developing cartridge according to claim 16, further comprising an engaging portion, wherein said developing cartridge is positioned by said engaging portion engaging with another developing cartridge disposed right therebelow.

* * * * *